United States Patent [19]

Kadokura et al.

[11] 4,207,100

[45] Jun. 10, 1980

[54] FORMATION OF ELECTROSTATIC LATENT IMAGE

[75] Inventors: Sadao Kadokura; Kazuhiko Honjo; Kazuhiro Kamei, all of Hino, Japan

[73] Assignee: Teijin Limited, Osaka, Japan

[21] Appl. No.: 904,331

[22] Filed: May 9, 1978

[30] Foreign Application Priority Data

May 12, 1977 [JP] Japan ..... 52-53763

[51] Int. Cl.[2] ..... G03G 13/044

[52] U.S. Cl. ..... 430/48; 355/3 TE

[58] Field of Search ..... 96/1 TE; 355/3 TE

[56] References Cited

U.S. PATENT DOCUMENTS

| | | | |
|---|---|---|---|
| 2,833,648 | 5/1958 | Walkup | 96/1 TE |
| 2,975,052 | 3/1961 | Fotland et al. | 96/1 TE |
| 3,147,679 | 9/1964 | Schaffert | 96/1 TE |
| 3,394,002 | 7/1968 | Bickmore | 96/1 TE |

FOREIGN PATENT DOCUMENTS

| | | | |
|---|---|---|---|
| 4725389 | 7/1972 | Japan | 96/1 TE |

*Primary Examiner*—Roland E. Martin, Jr.
*Attorney, Agent, or Firm*—Kenyon & Kenyon

[57] ABSTRACT

Disclosed is a process for forming an electrostatic latent image on a recording element having a dielectric layer superposed on a conductive electrode. In the first step of this process, the recording element and a xerographic sensitive element having a photoconductive layer also superposed on a conductive electrode are charged with the same polarity. In the second step, the photosensitive element is brought into virtual contact with the recording element so that the charged surface of the photoconductive layer in the photosensitive element is in face-to-face relationship with the charged surface of the dielectric layer in the recording element. In the third step, an external voltage is imposed between the two conductive electrodes, said voltage being of at least a magnitude for producing an electric field causing breakdown of minute air-gaps present between the contacted surfaces of the photosensitive element and the recording element and, before the completion of the external voltage imposition, an optical image is projected onto the photoconductive layer in the photosensitive element.

6 Claims, 13 Drawing Figures

FORMATION OF ELECTROSTATIC LATENT IMAGE

This invention relates to image formation by electrophotography. More particularly, it relates to an improvement in a process for forming an electrostatic latent image on a recording element by a charge transfer technique.

Many proposals have been heretofore made for the formation of an electrostatic latent image on a recording element by a charge transfer technique. For example, several TESI (an abbreviation of "Transfer of Electro-Static Image") processes are illustrated on pages 70 to 79, of R. M. Schaffert's "Electrophotography" (Japanese edition), published by Kyoritsu Shuppan.

In the TESI No. 3 process described in the above-mentioned publication, first an electrostatic image is formed in a conventional manner on a xerographic photosensitive layer supported on a conductive layer, and then, a dielectric receiving layer supported on a conductive layer is charged by means of a corona. The charged dielectric receiving layer is disposed on the electrostatic image formed surface of the photosensitive layer, and then, electrodes connected to the respective conductive layers are grounded. Thereafter, the photosensitive layer and the dielectric receiving layer are separated from each other, whereby the electrostatic image is transferred to the dielectric receiving layer. In this process, a principle is utilized such that, when two charged dielectric layers are brought into contact with or separated from each other, a breakdown of air-gaps between the two dielectric layers occurs, which causes charge transfer due to secondary electron emission.

The TESI No. 3 process is not advantageous in the resulting image quality. This is because, first the transferred electrostatic image is degraded in contrast between the dark area and the light area to the extent corresponding to the breakdown of air-gaps, as compared with the electrostatic image on the xerographic photosensitive layer. Secondly, secondary electron emission inevitably causes, to some extent, the disturbance of the electrostatic image and the uneven transfer thereof.

In the TESI No. 5 process also described in the above-mentioned publication, first a dielectric receiving layer supported on a transparent conductive substrate is placed on a xerographic photosensitive layer also supported on a conductive substrate so that the dielectric receiving layer is in face-to-face relationship with the photosensitive layer. Then, an external voltage is applied between the two conductive substrates and, simultaneously, an optical image is projected through the dielectric receiving layer onto the xerographic photosensitive layer. Finally, the dielectric receiving layer is separated from the photosensitive layer while the external voltage is applied between the two conductive substrates. In this process, a principle is utilized such that, in the regions of illumination, the potential gradient in the air-gap between the dielectric receiving layer and the photosensitive layer is subjected to breakdown by an increase in conductivity of the photosensitive layer, whereby the charge is deposited in this region; but in the regions of non-illumination no breakdown occurs in the air-gap because the photosensitive layer maintains its insulation. Consequently, an electrostatic image is formed on the dielectric layer. This TESI No. 5 process is also not satisfactory in the resulting image quality.

This is because, first, it is difficult to enhance the contrast between the dark area and the light area in the electrostatic image for the reason that the imposed external voltage is limited to an extent such that no breakdown of the air-gap occurs in the regions of non-illumination. Secondly, even minor nonuniformity in the air-gap spacing greatly influences the contrast. Thirdly, secondary electron emmission inevitably occurs upon the separation of the dielectric layer due to existence of the potential gradient in the air-gap.

Furthermore, the TESI No. 7 process is described in the above-mentioned publication, which process can be said to be a combination of the above-mentioned TESI No. 3 and No. 5 processes. In the TESI No. 7 process, first, a transparent dielectric receiving layer supported on a transparent conductive substrate is negatively charged by a corona charging device. Secondly, the charged dielectric layer is placed on a xerographic photosensitive layer also supported on a conductive substrate. So that the dielectric layer is in face-to-face relationship with the photosensitive layer. Then, an external voltage is applied between the two conductive substrates and, simultaneously, an optical image is projected onto the photosensitive layer, following a procedure similar to that mentioned with reference to the TESI No. 5 process. By charging the dielectric layer with negative polarity and further applying a high voltage, the potential gradient in the air-gap is enhanced, and charge transfer occurs in the regions of illumination. Since the negative charge of the dielectric layer is neutralized in the regions of illumination but remains in the regions of non-illumination, a charge contrast equal to the difference between the initial negative charge potential and the air-gap potential is obtained. The TESI No. 7 process is, however, still not satisfactory in that the initial negative charge potential cannot be large, because secondary electron emission inevitably occurs upon disposing the charged dielectric layer on the photosensitive layer, and accordingly, the resultant charge contrast is not desirably high.

Japanese Patent Laid-open Application No. 29142/76 discloses an electrophotographic charge transfer process wherein a dielectric receiving layer and a xerographic photosensitive layer are charged in approximately the same amount and with the same polarity; the two charged layers are brought into contact with each other, and; then, an optical image is projected onto the photosensitive layer, followed by separation of the two layers from each other. This process enables the reduction of the amount of the initial charge in the photosensitive layer and, thus, the reduction of pin-holes formed on the photosensitive layer due to local discharge. However, the resultant charge contrast is equal to the difference between the initial charge potential and the air-gap potential.

To sum up, it may be said that in the hithertofore proposed TESI processes, charge transfer is allowed to occur, irrespective of the characteristics of a xerographic photosensitive layer and the insulation characteristics of an air-gap, only in the regions of illumination. Therefore, these TESI processes are not advantageous in that, first, the charge contrast is lower than that obtained by the Carlson process; secondly, the disturbance of image occurs due to the secondary electron emission upon the separation of the dielectric layer from the photosensitized layer, and; thirdly, nonuniformity in the air-gap greatly influences the image quality.

A main object of the present invention is to provide a charge transfer process which has none of the defects encountered in the above-mentioned prior art processes, i.e., enables voluntary control of the potential of the electrostatic image while the desirably high contrast of the electrostatic image is maintained.

Other objects and advantages of the invention will be apparent from the following description.

In accordance with the present invention, there is provided a process for forming an electrostatic latent image on a recording element having a dielectric layer superposed on a conductive electrode, which comprises the steps of:

charging with the same polarity the recording element and a xerographic sensitive element having a photoconductive layer disposed on a conductive electrode;

bringing the photosensitive element in virtual contact with the recording element so that the charged surface of the photoconductive layer in the photosensitive element is in face-to-face relationship with the charged surface of the dielectric layer in the recording element, and;

then, imposing an external voltage between the two conductive electrodes, said voltage being of at least a magnitude for producing an electric field causing the breakdown of minute air-gaps present between the photosensitive element and the recording element and, before the completion of the external voltage imposition, projecting an optical image onto the photoconductive layer in the photosensitive element.

The main point of the invention resides in the fact that, first, the dielectric layer in a recording element and the photoconductive layer in a photosensitive element are charged with the same polarity and, then, after the recording element is brought into virtual contact with the photosensitive layer so that the charged surface of the dielectric layer in the recording element is in face-to-face relationship with the charged surface of the photoconductive layer in the photosensitive element, an external voltage is imposed between two conductive eletrodes, one of which is disposed in intimate contact with the dielectric layer in the recording element and the other of which is disposed in intimate contact with the photoconductive layer in the photosensitive element; the imposed voltage is of at least a magnitude sufficient for causing charge transfer not only in the regions of illumination, i.e. the light area of the optical image, but also in the regions of non-illumination, i.e. the dark area of the optical image. That is, charge transfer occurs in both the light and dark areas of the optical image. Therefore, voluntary control of the potential of the electrostatic image to be formed on the dielectric layer can be effected. This leads to an improvement in the quality and contrast of the resulting image.

The reason an electrostatic image of good quality and with a high contrast is formed by the process of the invention is presumed to be as follows. First, since the recording element and the photosensitive element are brought into contact with each other after the two elements are charged with the same polarity, undesirable secondary electron emission, occurring upon contacting the two elements, can be suppressed.

Secondly, the potential difference between the light area and the dark area of the electrostatic image, i.e. the charge contrast therebetween, can be voluntarily controlled. Upon the projection of an optical image onto the photoconductive layer, large amounts of carriers are generated in the region of the photoconductive layer, corresponding to the light area of the optical image and, in contrast, minor amounts of carriers are generated in the region corresponding to the dark area of the optical image. The carriers so generated migrate to the surface of the photoconductive layer due to an electric field built up by the initial charge voltage imposed in the first step of the process of the invention and the external voltage imposed in the third step thereof. In the light area of the image, the photoconductive layer becomes more conductive and, hence, large amounts of the carriers transfer from the photoconductive layer to the dielectric layer of the recording element across minute air-gaps present between the photoconductive layer and the dielectric layer. In other words, the voltage of the air-gap is maintained at the threshold voltage causing breakdown, and therefore, the carriers generated in the photoconductive layer by light exposure transfer to the recording element. Therefore, not only the initial charge of the recording element, produced in the first step of the process of the invention, is completely neutralized, but also, with an increase in the amount of the carriers deposited on the recording element, the potential of the recording element increases until the recording element becomes charged with a polarity opposite to that of the initial charge. In contrast, in the dark area of the optical image, the photoconductive layer remains capacitive and only a minor amount of the carriers transfers from the photoconductive layer to the dielectric layer. Only a minor part of the initial charge of the recording element is neutralized and, hence, the potential of the recording element changes to a slight extent. The above-discussed generation and transfer of the carrier can be controlled by varying the magnitude of the external voltage and the time period of its application, and the amount of light exposure. Thus, it can be said that the potential in the light area of the electrostatic latent image formed on the recording element is capable of being voluntarily controlled by varying the magnitude of the external voltage, the time period of its application and the amount of light exposure, and; furthermore, the potential in the dark area of the electrostatic latent image is also capable of being voluntarily controlled by varying the initial charge produced in the recording element in the first step of the process of the invention.

Thirdly, since the carrier transfer occurring across the minute air-gaps is effected both in the dark and light areas, and before the two elements are separated from each other, the variations in carrier transfer occurring due to nonuniformity in the air-gaps are negligible.

The invention will now be described illustratively with reference to the accompanying drawings in which.

Figure 1:
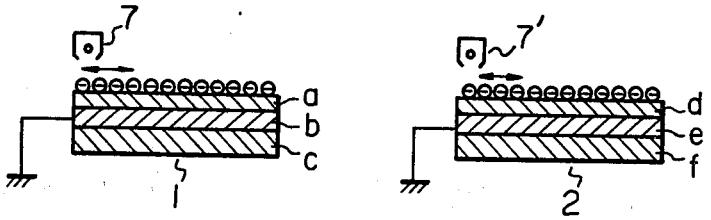
FIG. 1 is a diagrammatic view illustrating the first step of the process of the invention.
Figure 2:
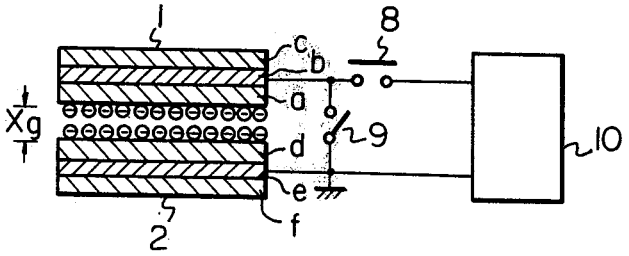
FIG. 2 is a diagrammatic view illustrating the second step in the process of the invention.
Figure 3:
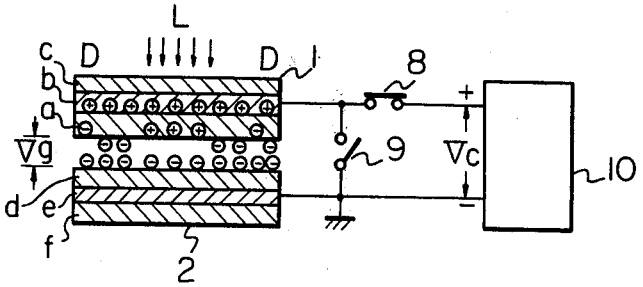
FIG. 3 is a diagrammatic view illustrating the third step in the process of the invention.

In FIGS. 1 through 3 there is illustrated a simplified embodiment of the process of the invention. As shown in FIG. 1, a xerographic photosensitive element 1 comprised of a photoconductive layer (a), a conductive layer (b) and a substrate (c), and a recording element 2 comprised of a dielectric layer (d), a conductive layer (e) and a substrate (f) are used. The respective substrates (c) and (f) are adapted so as to enhance the service life and handling properties of the photosensitive element 1 and the recording element 2. The substrates (c) and (f) may be made of, for example, opaque insulation sheets such as paper, transparent organic polymer insulation sheets such as those made of polyethylene terephthalate and polystyrene, and insulating or conductive inorganic sheets such as glass sheet and aluminum sheet. Among these substrates, transparent insulating sheets made of an organic polymeric material such as polyethylene terephthalate or polystyrene are preferable from the standpoints of service life, dimensional stability, weight, handling properties and production cost. When either or both of the substrates (c) and (f) used are conductive, either or both of the conductive layers (b) and (e) need not be used.

The conductive layers (b) and (e) may be made of, for example, films or thin sheets of metals or metal oxides, such as aluminum, copper, silver, tin oxide and indium oxide. The conductive layers also may be coated films of a polyelectrolyte such as polyvinyl trimethylammonium chloride.

The photoconductive layer a may be made of any convenient organic or inorganic photoconductive materials or their mixtures. Typical inorganic photoconductive materials are, for example, crystalline compounds such as cadmium sulfide-selenide and cadmium sulfide and their mixtures, and photoconductive glasses such as amorphous selenium, selen-tellurium and selenium arsenide. Zinc oxide-resin mixtures are also included in the photoconductive material. Typical organic photoconductive materials are, for example, polyvinyl carbazole and phthalocyanine pigments.

Figure 4:
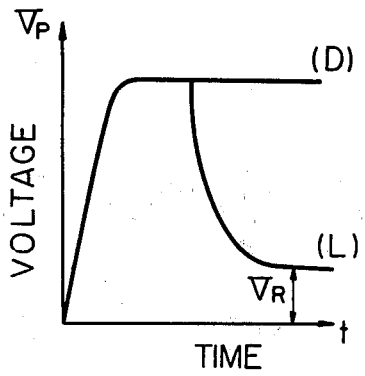
FIG. 4 is curves illustrating the potential characteristics of a xerographic photosensitive element.

The xerographic photosensitive element 1 should exhibit characteristics such that, as shown in FIG. 4, the charge voltage ($V_p$) of the photosensitive element imposed by means of the corona charge is attenuated with the lapse of time (t) only to a negligible extent in a dark place (curve (D)) but to a large extent in a light place (curve (L)). It is preferable that the charge voltage ($V_p$) in a dark place be such that it produces a large charge contrast between the regions of illumination and the regions of nonillumination.

The dielectric layer (d) may be made of materials which are electrically highly insulating. Such materials include, for example, polystyrene, polyethylene, polypropylene, polycarbonate and polyethylene terephthalate. The dielectric layer may be either a thin film placed on the conductive layer or a coated layer from a dielectric solution.

In the charge transfer process of the invention, first, as shown in FIG. 1, the photosensitive element 1 is charged with, for example, negative polarity by moving a corona charging device 7 relative to the photosensitive element 1 in a dark place. Similarly, the recording element 2 is charged with the same polarity as that of the photosensitive element 2 by moving a corona charging device 7'. This step is hereinafter referred to as the first step. The voltage imposed on the recording element 2 by the corona charging device should be suitably determined because the imposed voltage closely relates to the potential in the dark regions of a charge image. Usually, the voltage may be in the range of from several hundred to several thousand volts. It is preferable that the voltage imposed on the recording element 2 be larger than that on the photosensitive element 1. This is because the charge transfer voltage, mentioned hereinafter, imposed by an external potential source can be reduced and, thus, an external potential source of a small capacity can be used.

Then, as shown in FIG. 2, the charged photosensitive element 1 is brought in virtual contact with the charged recording element 2, so that the charged surface of the photosensitive element 1 is in face-to-face relationship with the charged surface of the recording element 2. This step is hereinafter referred to as the second step. In general, the surfaces of the photoconductive layer a and of the dielectric layer d are uneven and, even when these surfaces are brought into intimate contact with each other, there is a minute and nonuniform air-gap spacing of approximately 5 to 10 microns between the two surfaces. Although the presence of a distribution of such air-gaps influences the image quality only to a minor extent in the process of the invention, as discussed hereinbefore, it is preferable to control the air-gap spacing so that it is uniform. For this purpose, a coated screen pattern layer may be formed on the photosensitive layer (a), which screen pattern layer is made of an insulating material, such as a photosensitive polymer, and has a uniform thickness in the range of from 2 to 100 microns, preferably 5 to 10 microns.

Then, the respective conductive layers (b) and (e) in the contacted photosensitive element and recording element are, as shown in FIG. 2, connected to a potential source 10, while a switch 8 is opened. The use of such conductive layers (b) and (e) is advantageous in that they provide a simple electrode constitution for the charge transfer voltage imposing system.

Figure 6:
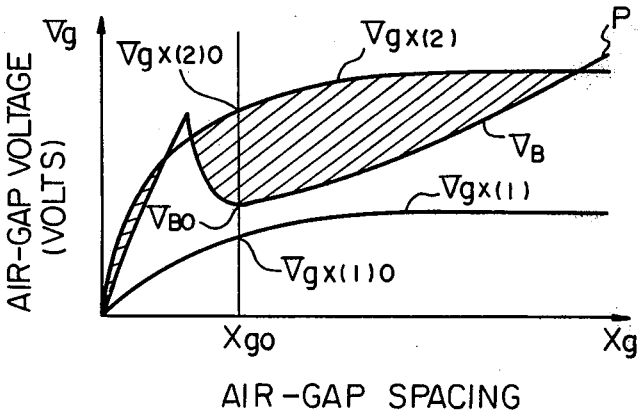
FIG. 6 is a modified Pachen curve.

Thereafter, as shown in FIG. 3, a charge transfer voltage ($V_c$) is imposed between the photosensitive element and the recording element by closing the switch 8, and an optical image is projected on the photosensitive layer (a). This step is hereinafter referred to as the third step. By the term "optical image" used herein is meant an image which is of visible light, X-ray or any other radiation capable of generating carriers in the photoconductive layer. The imposed voltage ($V_c$) must be sufficient for causing charge transfer through the air-gap spacing ($X_g$), as hereinbefore discussed. The imposed voltage ($V_c$) is, prior to the optical image projection, distributed substantially equally to the photosensitive layer (a), the dielectric layer (b) and the air-gap spacing ($X_g$), as if these layers and air-gap spacing constitute an equivalent series circuit of the capacitive elements. When the voltage appearing across the air-gap exceeds the air-gap breakdown voltage ($V_B$), i.e.

the voltage expressed by a modified Pachen curve, shown in FIG. 6, air-gap breakdown occurs and a charge transfers across the air-gap spacing ($X_g$). For example, when the air-gap spacing ($X_g$) is $X_{go}$ and the potential of the air-gap spacing is raised from $V_{gx(1)o}$ to $V_{gx(2)o}$ by imposing a voltage ($V_c$), a charge will transfer until the voltage across the air-gap spacing ($X_g$) is reduced to the breakdown value ($V_{BO}$).

Figure 5:
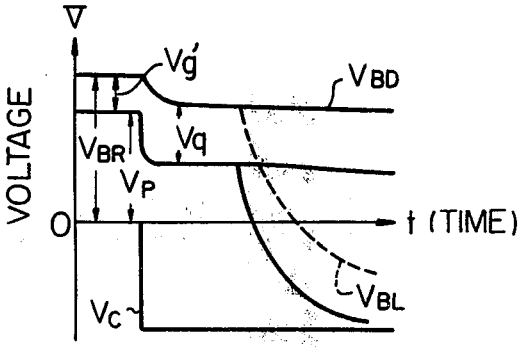
FIG. 5 is curves illustrating the potential characteristics of a xerographic photosensitive element and a recording element.

Thus, as shown in FIG. 5, when an external voltage ($V_c$) is imposed, the voltage across the air-gap spacing ($X_g$) varies, depending upon the voltage ($V_p$) of the photosensitive element 1 prior to the application of the external voltage ($V_c$), the voltage ($V_{BR}$) of the recording element 2 prior to the application of the external voltage ($V_c$) and the air-gap spacing ($X_g$), from $V_g'$ corresponding to $V_{gx(1)}$ shown in FIG. 6 to $V_{gx(2)}$. Therefore, a charge transfers across the air-gap spacing ($X_g$), the potential ($V_{BR}$) of the recording element changes, and the voltage across the air-gap spacing ($X_g$) varies to the threshold voltage value ($V_g$) conforming to the above-mentioned Pachen curve (P). Thus, the voltage ($V_c$) should be imposed in a direction such that the above-mentioned operation is ensured.

When an optical image is projected onto the photosensitive element, the photoconductive layer (a) becomes conductive by the generation of carriers in the regions of illumination, but not in the regions of non-illumination. In other words, the potentials in the respective regions of non-illumination in the recording element, the photosensitive element and the air-gap vary to a very limited extent as shown in FIG. 5. In contrast, in the regions of illumination, the charge density increases with an increase in the amount of light exposure, which leads to, in turn, neutralization of the initial charge, i.e. potential change, in the photosensitive element, potential change in the air-gap, and neutralization of the initial charge in the recording element. Thus, the potential of the photosensitive element comes up to the imposed voltage ($V_c$) and also the potential of the recording element varies, and consequently, the polarity is reversed. A desirably enhanced charge contrast can be obtained by continuing light exposure for a suitable period of time.

In the third step, it is essential that the optical image projection is carried out while the external voltage is applied, that is, the optical image projection is commenced before the completion of the external voltage application. Furthermore, in order to improve the tone gradient of the resultant image either one or both of the optical image projection and the external voltage imposition may be conducted in an intermittent manner.

Figure 7:
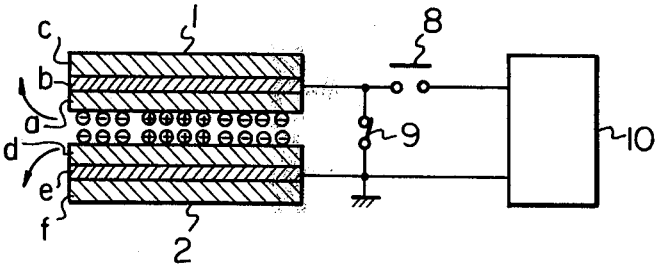
FIG. 7 is a diagrammatic view illustrating the step following the third step of the process of the invention.

The recording element having an electrostatic image formed thereon in the above-mentioned third step may be separated from the photoconductive layer in the state that, as shown in FIG. 3, a switch 8 is closed and a switch 9 is opened. The resultant image is satisfactory from a practical standpoint, as substantiated in Examples 3 and 4, below. However, in order to completely avoid noise in the resultant image, the recording element is preferably separated from the photoconductive layer in the state that, as shown in FIG. 7, the switch 8 is opened and a switch 9 is closed, and thus, the conductive layers (b) and (e) are short-circuited. As a result, the electric field produced by imposing the voltage ($V_c$) vanishes, and thus, the voltage of the photosensitive element is reduced to an approximate value corresponding to $V_c=0$. $X_{go}$ in the dark area and in the light area reaches equilibrium at a voltage of ($V_{BO}$). Therefore, as illustrated in FIG. 5, the voltage of the recording element becomes $V_{BL}$ in the light area and $V_{BD}$ in the dark area and thereafter, when the imposed external voltage ($V_c$) becomes zero in a dark place, the voltage ($V_g$) of the air-gap ($X_{go}$) reaches equilibrium at a voltage of $V_{BO}$ or lower. Accordingly, undesirable secondary electron emission effects can be suppressed when the photosensitive element is separated from the recording element whether or not the respective conductive layers are short-circuited or broken.

In the above-mentioned step wherein the xerographic photosensitive element and the recording element are brought into contact with each other, a thin layer of an insulating liquid may be interposed between the two elements. This interposing serves more to suppress the undesirable secondary electron emission occurring upon separation of the two elements. The insulating liquid used should possess an insulating capability to such an extent that it significantly reduces the resolving power of the charge image. Suitable insulating liquids include, for example, liquid silicone, fluorinated carbon, mineral oil, liquid aromatic hydrocarbon and liquid aliphatic hydrocarbon. The interposing of the insulating liquid may be conducted by coating therewith at least one of the photosensitive element and the recording element immediately before the contact of the two elements.

The invention will be further described specifically with regard to on an apparatus advantageously used for the practice of the process of the invention.

Figure 8:
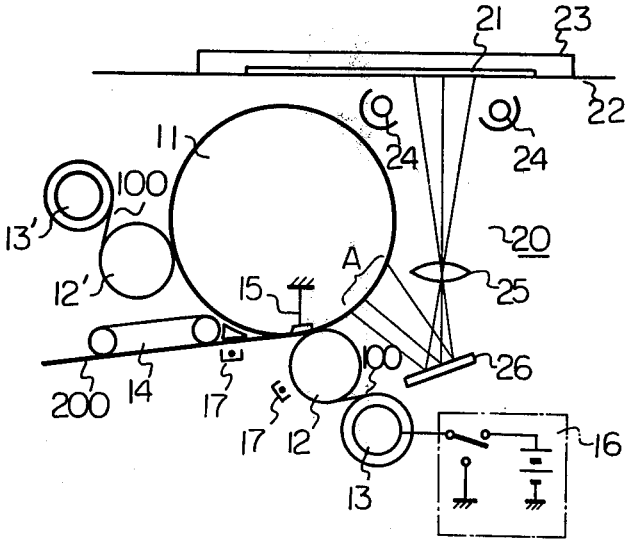
FIG. 8 is a diagrammatic view of an apparatus according to one embodiment of the invention.
Figure 9:
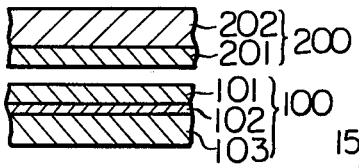
FIG. 9 is a diagrammatic view of a combination of a xerographic photosensitive element and a recording element.

In FIG. 8, a cylinder 11 is rotated in either a clockwise or counterclockwise direction by a driving means (not shown). The periphery, of the cylinder 11 is preferably covered with an insulating plastic rubber material. The cylinder 11 receives an optical image in the region A on the periphery thereof from an optical image projecting means 20. A pair of pressing rollers 12 and 12' are arranged in intimate contact with the cylinder 11 and on both sides of the optical image receiving region A. If desired, the peripheries of the pressing rollers 12 and 12' are covered with an insulating plastic rubber material. A pair of supporting rollers 13 and 13', arranged in parallel with the pressing rollers 12 and 12', are rotated in syncronization with the rotation of the cylinder 11. When the cylinder 11 is rotated, for example, in a counterclockwise direction, a photosensitive sheet 100, withdrawn from the supporting roller 13, is carried along with the cylinder 11 and taken up by the supporting roller 13'. The photosensitive sheet 100 is a laminate comprised of a photoconductinve layer 101, a transparent conductive layer 102 and a transparent substrate layer 103, as shown in FIG. 9. An insulating recording sheet 200 comprised of a dielectric layer 201 superposed or coated on a conductive substrate layer 202 (shown in FIG. 10) is supplied by a supply means 14 to the contacting point of the cylinder 11 with the pressing roller 12 along the tangent line. The supply means 14 comprises an endless conveyor provided with a vacuum suction means and is moved in syncronization with the cylinder 11.

The optical image projecting means 20 comprises a transparent plate 22 on which an original image sheet 21 and a cover 23 are placed. Incident light from sources 24 is reflected on the original image and reaches the image receiving region A via a lens 25 and a mirror 26. In the optical image recieving region A, the optical image is projected onto the photosensitive sheet 100 and an electrostatic image is formed on the insulating recording sheet 200, in the manner hereinbefore discussed. A means for applying an external voltage to the photosensitive sheet 100 and the recording sheet 200 comprises a grounded electrode 15 and an electric potential source 16. One of the two electrodes in the potential source 16 is connected via the supporting roller 13 with the transparent electrode layer 102 (shown in FIG. 9) of the photosensitive layer 100, and the other electrode is grounded. The grounded electrode 15 is connected to the conductive layer 202. Thus, a charge transfer voltage is imposed by the potential source 16 between the photoconductive layer 101 of the photosensitive sheet 100 and the dielectric layer 201 of the recording sheet 200.

Figure 10:
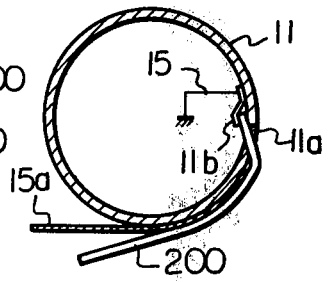
FIG. 10 is a diagrammatic view illustrating a means for holding one end of the recording element.

As shown in FIG. 10, the connection of the recording sheet 200 with the grounded electrode 15 is preferably effected by an elastic holding member **11*b* of a conductive material fitted on the inner wall of the cylinder 11. One end of the recording sheet 100 is passed through a slit 11*a* provided in the cylinder 11 and extending in the axial direction, and is removably clamped by the elastic holding member 11. When the recording sheet 200 which is used is of a laminar structure shown in FIG. 9, it is preferable to insert between the recording element 200 and the periphery of the cylinder 11 a backing electrode sheet 15*a* of a conductive and elastic material such as conductive rubber. When the recording sheet 200 is of a laminar structure comprised of a dielectric layer, a transparent conductive layer and a transparent substrate layer, the transparent conductive layer can be connected to the grounded electrode 15 by providing a plurality of claw projections on the holding member 11*b***.

In use and operation of the apparatus shown in FIG. 8, first, the cylinder 11 is in a stopped position wherein the elastic holding member **11*b* (shown in FIG. 10) is positioned upstream of the contacting point of the cylinder 11 with the pressing roller 12 relative to the rotation of the cylinder 11. The recording sheet 200 is supplied by the supply means 14 to the cylinder 11 where the end of the sheet 200 is clamped by the holding member 11*b*. Then, when the cylinder starts to rotate in a counterclockwise direction, the supporting roller 13' starts to take up the photosensitive sheet 100. The recording sheet 200 and the photosensitive sheet 100 are charged with the same polarity by corona charging means 17. The recording sheet 200 is brought into contact with the photosensitive sheet 100 at the contacting point of the cylinder 11 with the pressing roller 12. The cylinder 11 rotates by an angle corresponding to the predetermined size of the recording sheet, and then, stops. Upon stopping of the cylinder, the recording sheet and the photosensitive sheet are in contact with each other over at least the length corresponding to the above-mentioned, predetermined size of a sheet. Then, an external voltage is applied between the photosensitive sheet 100 and the recording sheet 200 by the voltage applying means 16, and simultaneously therewith, the cylinder 11 starts to rotate in a clockwise direction and the optical image projecting means 20 operates. Concurrently, the supporting roller 13 and the supply means 14 move in directions opposite to the above-mentioned directions. In synchronization with the reverse rotation of the cylinder 11, the transparent sheet 22 moves while supporting thereon the original image sheet 21. Thus, an electrostatic latent image is formed on the dielectric layer 201 of the recording sheet 200. The photosensitive sheet 100 and the recording sheet 200 are separated at the contacting point of the cylinder 11 with the pressing roller 12, that is, the photosensitive sheet 100 is taken up by the supporting roller 13 via the pressing roller 12, and the recording sheet 200 is transferred in the reverse direction by the supply means 14. When the cylinder 11 reaches the initial stop position, it stops and the respective means are re-set for the succeeding cycle. The recording sheet 200**, having the charge image formed thereon, is sent to a developing position (not shown).

Instead of projecting an optical image while the contacted photosensitive recording sheets are carried in a clockwise direction, the projection of the optical image may be carried out while the cylinder is rotated in a counterclockwise direction.

The invention will be further described by means of the following examples.

EXAMPLE 1

A commercially available zinc oxide-coated paper (trade name Fx Canon) was used as the xerographic photosensitive sheet. The recording sheet used was prepared as follows. A polyethylene terephthalate film having a thickness of 75 microns was metallized with indium oxide to form a transparent conductive layer of an approximately 100 angstrom thickness on the film. Furthermore, another polyethylene terephthalate film having a thickness of 9 microns was closely adhered onto the metallized surface to form a dielectric layer.

The xerographic photosensitive sheet was closely adhered onto an aluminum sheet electrode, which electrode was grounded. The indium oxide conductive layer of the recording sheet was also grounded as shown in FIG. 1. The photosensitive sheet and the recording sheet were charged with negative polarity in a dark place by using a corona charging device. The potentials of the photosensitive and recording sheets were −800 V and −1,200 V, respectively.

The negatively charged photosensitive and recording sheets were brought into contact with each other so that the respective charged surfaces were in face-to-face relationship. Light was projected onto the zinc oxide layer from the recording sheet side through a screen having light areas and dark areas by using a tungsten lamp, and simultaneously therewith, an external voltage ($V_c$) was imposed between the grounded aluminum sheet electrode and the indium oxide conductive layer by using a DC voltage source (6525A type, supplied by Hewlett Packard). Then, the indium oxide conductive layer was short-circuited with the grounded aluminum sheet electrode in a dark place, and thereafter, the recording sheet was separated from the photosensitive sheet.

Figure 11:
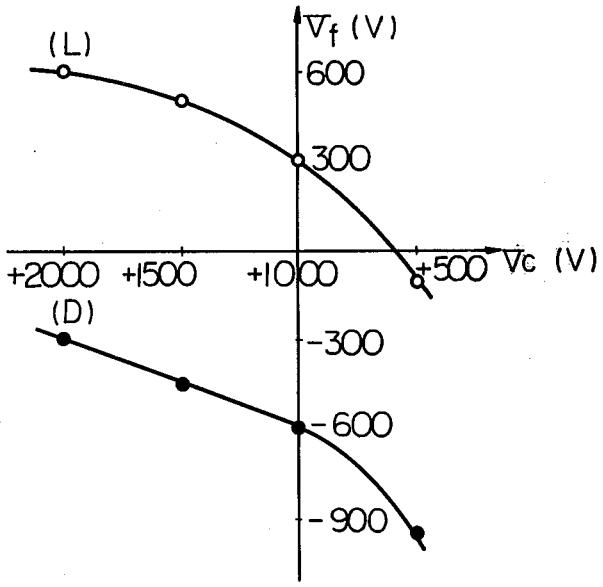
FIG. 11 is curves illustrating the relationship of the voltage applied with the contrast of an electrostatic image.

The potentials in the dark areas (D) and the light areas (L) of the charge image formed on the dielectric layer were measured when the indium oxide conductive layer was short-circuited with the grounded aluminum sheet electrode. Results are shown in FIG. 11. The following will be seen from FIG. 11.

(1) The contrast between the dark areas (D) and the light areas (L), i.e. 900 V, is larger than that (800 V) obtained from a similar zinc oxide-coated photosensitive paper by a Carlson procedure.

(2) The potentials in the dark areas (D) and the light areas (L) can be greatly varied by changing the magnitude of the applied voltage. Furthermore, the contrast between the dark areas (D) and the light areas (L) varies to some extent depending upon the magnitude of the applied voltage. This advantage cannot be obtained in conventional electrophotographic processes.

(3) The holding time and the amount of the charge image can be varied by selecting the material of the dielectric layer. Therefore, the application of toners in the image developing step is not restricted by time, and the image density is not reduced.

EXAMPLE 2

Following a procedure similar to that mentioned in Example 1, a charge image was formed on a recording sheet. The recording sheet used was prepared by coating an indium oxide metallized polyethylene terephthalate sheet, similar to that used in Example 1, with an epoxy resin of approximately 10 microns thickness instead of applying a 9 micron thick polyethylene terephthalate film.

When an external voltage ($V_c$) of $-1{,}200$ V was applied, the potentials in the dark areas (D) and the light areas (L) of the charge image formed on the dielectric layer were $-600$ V and $+300$ V, respectively. Under these conditions, an original test chart was copied and the resultant latent image was developed by using a developing solution (trade name, BS-250 supplied by Ricoh Co.). The obtained positive-positive image was of good fidelity.

EXAMPLE 3

The xerographic photosensitive sheet used was prepared by coating a sandblast-finished aluminum sheet (conductive substrate), having a thickness of 1 mm, with a solution of a mixture of polyvinyl carbazole (trade name, Luvican supplied by Bayer A. G.), trinitrofluorenone and polycarbonate, dissolved in a mixture of chlorobenzene and benzene. The recording sheet used was prepared by metallizing one surface of a polyethylene terephthalate film (dielectric layer) having a thickness of 9 microns, with indium oxide (transparent electrode layer) at a thickness of approximately 100 angstrom.

The photosensitive sheet and the recording sheet were charged with positive polarity in a dark place by using a corona charging device. The potentials of the photosensitive and recording sheets were 1,100 V and 900 V, respectively. The positively charged two sheets were brought into contact with each other so that the respective charged surfaces were in face-to-face relationship. An external voltage ($V_c$) of 1,400 V was applied between the two sheets so that the indium oxide layer of the recording sheet and the aluminum substrate of the photosensitive sheet were charged with positive polarity and with negative polarity, respectively. Simultaneously with the application of the voltage ($V_c$), light was projected through the transparent recording sheet onto the photosensitive sheet by using a tungsten lamp. Thereafter, the recording sheet was separated from the photosensitive sheet while the aluminum substrate and the indium oxide layer were maintained in an insulated condition. Then, the potential of the recording sheet was measured by using a vibrating-reed electrometer.

Figure 12:
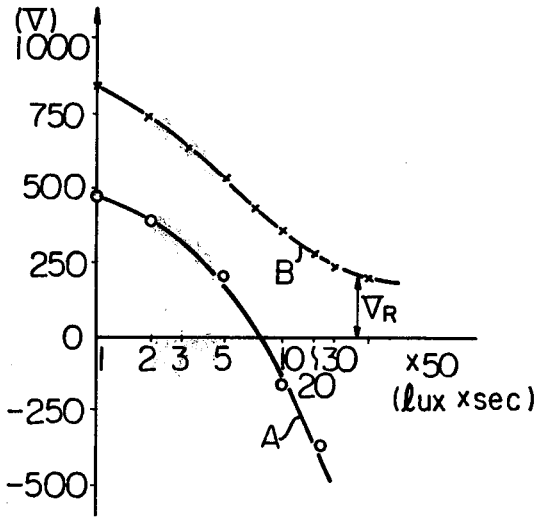
FIG. 12 is curves illustrating the relationship of the voltage in the light area with the amount of light exposure.

Results are shown in FIG. 12, in which curve A shows the potential of the recording sheet after being separated from the photosensitive layer and curve B shows attenuation of the surface potential of a light-exposed similar xerographic photosensitive sheet obtained by a Carlson process. It will be seen from FIG. 12 that the contrast of the electrostatic latent image formed on the recording sheet by the process of the invention is larger than the contrast of the similar image obtained by a Carlson process. It will also be seen that, even in the case where residual voltage ($V_R$) is observed, the voltage of the recording sheet can be of opposite polarity depending upon the light-exposure. Therefore, undesirable background noise can be mitigated or avoided. This is in a striking contrast to a Carlson process wherein the residual voltage ($V_R$) causes background noise.

EXAMPLE 4

The procedure mentioned in Example 3 was repeated wherein an electrostatic latent image was formed on the recording sheet by using Test Chart No. 1-R (published by Electrophotographic Society, 1975) as an original image. The latent image was developed by using a developing solution (trade name, Pana-slide). The developed image was evaluated by using a microdensitometer (PDM-5 type supplied by Konishiroku Photographic Film Co.).

Figure 13:
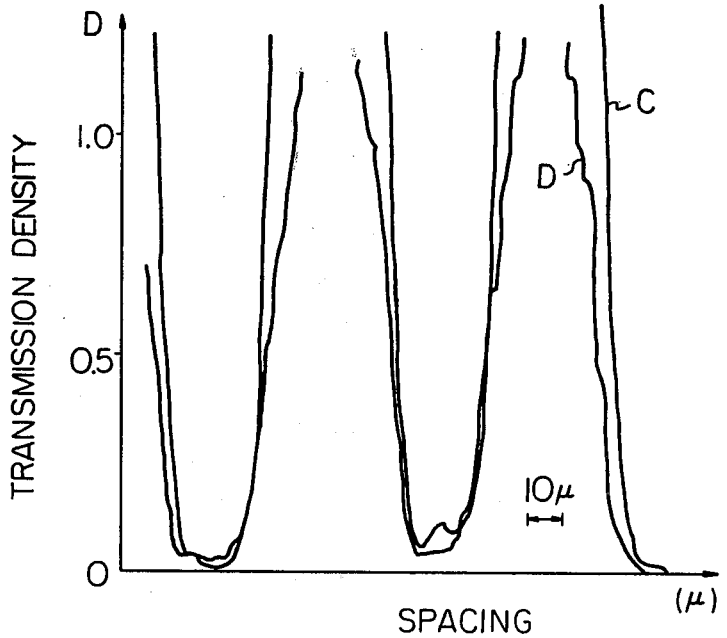
FIG. 13 is curves illustrating resolving powers of toner images.

Results are shown in FIG. 13. In FIG. 13, curve C shows the resolving power for 15 stripes per mm in the Test Chart No. 1-R and curve D shows the resolving power of the toner developed image formed on the recording sheet by using the above-mentioned Test Chart No. 1-R. The potentials in the image area and in the background area of the recording sheet for the curve D were $+200$ V and $-250$ V, respectively. It will be seen from FIG. 13 that a toner image having a high density, high resolving power and no background noise can be obtained by forming an electrostatic latent image of an opposite polarity according to the process of the invention.

In the above-mentioned Examples 3 and 4, the recording sheet was separated from the photosensitive sheet while the respective electrodes in the two sheets were maintained in an insulated condition. However, similar results could be obtained even when the separation of the recording sheet was carried out while the voltage was applied to the respective electrodes in the two sheets. Thus, it can be said that, according to the process of the invention, the xerographic photosensitive sheet dominantly functions as a condenser in a dark place, and the latent image quality is not influenced by the separation of the recording sheet from the photosensitive sheet. This is particularly true when the latent image formed is of opposite polarity.

What we claim is:

1. A process for forming an electrostatic latent image on a recording element having a dielectric layer superposed on a conductive electrode, which comprises the steps of:

charging with the same polarity the recording element and a xerographic sensitive element having a photoconductive layer superposed on a conductive electrode;

bringing the photosensitive element in virtual contact with the recording element so that the charged surface of the photoconductive layer in the photosensitive element is in face-to-face relationship with the charged surface of the dielectric layer in the recording element; and then, imposing an external voltage between the two conductive electrodes, said voltage having a polarity to produce a charge on the conductive electrode on which the photoconductive layer is superposed which is opposite to the polarity of the charge on the photoconductive layer, and being of at least a magnitude sufficient for producing an electric field causing break down of air-gaps present between the contacted surfaces of the photosensitive element and the recording element, and simultaneously with or prior to the external voltage imposition, projecting an optical image onto the photoconductive layer in the photosensitive element.

2. A process according to claim 1 wherein the electrostatic latent image is such that the image area and the background area have potentials with different polarity.

3. A process according to claim 1 or 2 wherein the recording element, charged with the same polarity as that of the photosensitive element, has a charge voltage larger than that of the photosensitive element.

4. A process according to claim 1 or 2 wherein at least one step of the external voltage imposition and the optical image projection is intermittently carried out.

5. A process according to claim 1 or 2 wherein, after the optical image projection, the potentials of the two conductive electrode layers are made into the same, and then, the recording element is separated from the photosensitive element.

6. A process according to claim 1 or 2 wherein the photosensitive element is brought into virtual contact with the recording element in a way such that an insulating liquid lies between the confronting surfaces of the two elements.

* * * * *